US012117192B2

(12) United States Patent
Liu

(10) Patent No.: US 12,117,192 B2
(45) Date of Patent: Oct. 15, 2024

(54) AIR CONDITIONER AND SELF-CLEANING CONTROL METHOD THEREFOR AND DEVICE THEREOF, AND COMPUTER READABLE STORAGE MEDIUM

(71) Applicant: GD MIDEA AIR-CONDITIONING EQUIPMENT CO., LTD., Guangdong (CN)

(72) Inventor: Bo Liu, Guangdong (CN)

(73) Assignee: GD MIDEA AIR-CONDITIONING EQUIPMENT CO., LTD., Guangdong (CN)

( * ) Notice: Subject to any disclaimer, the term of this patent is extended or adjusted under 35 U.S.C. 154(b) by 164 days.

(21) Appl. No.: 17/750,633

(22) Filed: May 23, 2022

(65) Prior Publication Data

US 2022/0282878 A1 Sep. 8, 2022

Related U.S. Application Data

(63) Continuation of application No. PCT/CN2020/088411, filed on Apr. 30, 2020.

(30) Foreign Application Priority Data

Nov. 27, 2019 (CN) ..... 201911184658.1

(51) Int. Cl.
*F24F 11/42* (2018.01)
*F24F 11/41* (2018.01)
(Continued)

(52) U.S. Cl.
CPC ..... *F24F 11/42* (2018.01); *F24F 11/41* (2018.01); *F24F 11/61* (2018.01); *F24F 11/64* (2018.01);
(Continued)

(58) Field of Classification Search
CPC .. F24F 11/41; F24F 11/42; F24F 11/43; F24F 11/61; F24F 11/67
See application file for complete search history.

(56) References Cited

U.S. PATENT DOCUMENTS

2018/0283749 A1 10/2018 Iuchi

FOREIGN PATENT DOCUMENTS

CN 104913452 A 9/2015
CN 107228451 A 10/2017
(Continued)

OTHER PUBLICATIONS

CN 104848738 (English Translation) (Year: 2015).*
(Continued)

*Primary Examiner* — Jonathan Bradford
(74) *Attorney, Agent, or Firm* — Scully, Scott, Murphy & Presser, P.C.

(57) ABSTRACT

A self-cleaning control method for an air conditioner and a device and a computer readable storage medium associated with the method are provided. According to the method, in response to the air conditioner entering a self-cleaning mode, the air conditioner is controlled to perform a cooling operation. During the cooling operation, a high-pressure-side pressure of an exhaust port of a compressor is acquired and a duration of the cooling operation is recorded. Based on the high-pressure-side pressure and the duration, the air conditioner is controlled to switch to perform a heating operation. During the heating operation, a temperature at a bottom of an outdoor heat exchanger is acquired and a duration of the heating operation is recorded. Based on the temperature and the duration, the air conditioner is controlled to exit the self-cleaning mode.

15 Claims, 4 Drawing Sheets

(51) Int. Cl.

| | |
|---|---|
| ***F24F 11/61*** | (2018.01) |
| ***F24F 11/64*** | (2018.01) |
| ***F24F 11/67*** | (2018.01) |
| ***F24F 11/871*** | (2018.01) |
| *F24F 11/43* | (2018.01) |

(52) U.S. Cl.
CPC ..... *F24F 11/67* (2018.01); *F24F 11/871* (2018.01); *F24F 11/43* (2018.01)

(56) References Cited

FOREIGN PATENT DOCUMENTS

| | | | |
|---|---|---|---|
| CN | 107388658 | A | 11/2017 |
| CN | 108489030 | A | 9/2018 |
| CN | 104848738 | B | 3/2019 |
| CN | 110173828 | A | 8/2019 |
| CN | 110822636 | A | 2/2020 |
| EP | 3343118 | A1 | 7/2018 |
| JP | H07218055 | A | 8/1995 |
| WO | 2018198390 | A1 | 11/2018 |

OTHER PUBLICATIONS

CN 110500701 (English Translation) (Year: 2019).*
Extended European Search Report dated Dec. 9, 2022 received in European Patent Application No. EP 20892545.3.
International Search Report dated Aug. 12, 2020 received in International Application No. PCT/CN2020/088411.
First Office Action dated Jul. 15, 2020 received in Chinese Patent Application No. CN 201911184658.1.
Notification to Grant Patent Right for Invention dated Apr. 2, 2021 received in Chinese Patent Application No. CN 201911184658.1.

* cited by examiner

AIR CONDITIONER AND SELF-CLEANING CONTROL METHOD THEREFOR AND DEVICE THEREOF, AND COMPUTER READABLE STORAGE MEDIUM

CROSS-REFERENCE TO RELATED APPLICATIONS

This application is a continuation application of PCT International Application No. PCT/CN2022/088411, which claims priority to Chinese Patent Application No. 201911184658.1, filed before the China National Intellectual Property Administration on Nov. 27, 2019, the entire contents of which are incorporated herein by reference for all purposes. No new matter has been introduced.

FIELD

The present disclosure relates to the field of air conditioners, and more particularly, to a self-cleaning control method for an air conditioner, a self-cleaning control device of an air conditioner, an air conditioner, and a computer readable storage medium.

BACKGROUND

At present, some air conditioners in the market have a self-cleaning function in the related art, an indoor unit is controlled to stop working so as to frost an evaporator of the indoor unit, then the indoor unit is defrosted, and the dust is removed through the defrosted water, so that the self-cleaning of the air conditioner is realized.

However, upon intensive research by the applicant, it was found that the air conditioner of the related art may cause an excessively high system pressure exceeding a normal operating pressure of a compressor during the self-cleaning process. It is not conducive to the stable operation of the air conditioner, and moreover, a frosting effect is dissatisfactory, so that a cleaning effect cannot meet normal user requirements.

SUMMARY

The present disclosure aims to solve at least one of the technical problems in the related art.

Therefore, a first object of the present disclosure is to provide a self-cleaning control method for an air conditioner, which can solve problems of an insufficient frosting degree and an incomplete cleaning effect during a self-cleaning process of the air conditioner, thereby further improving a cleaning effect of the air conditioner and improving the user experience.

A second object of the present disclosure is to provide a self-cleaning control device of an air conditioner.

A third object of the present disclosure is to provide an air conditioner.

A fourth object of the present disclosure is to provide a computer readable storage medium.

In order to achieve the above objective, a self-cleaning control method for an air conditioner according to embodiments of a first aspect of the present disclosure includes: controlling, in response to the air conditioner entering a self-cleaning mode, the air conditioner to perform a cooling operation; during the cooling operation of the air conditioner, acquiring a high-pressure-side pressure of an exhaust port of a compressor, and recording a duration of the cooling operation of the air conditioner; controlling, based on the high-pressure-side pressure and the duration of the cooling operation of the air conditioner, the air conditioner to switch to perform a heating operation; during the heating operation of the air conditioner, acquiring a temperature at a bottom of an outdoor heat exchanger, and recording a duration of the heating operation of the air conditioner; and controlling, based on the temperature at the bottom of the outdoor heat exchanger and the duration of the heating operation of the air conditioner, the air conditioner to exit the self-cleaning mode.

According to the self-cleaning control method for the air conditioner, in response to the air conditioner entering the self-cleaning mode, the air conditioner is controlled to perform a cooling operation; during the cooling operation of the air conditioner, the high-pressure-side pressure of an exhaust port of the compressor is acquired, and the duration of the cooling operation of the air conditioner is recorded; based on the high-pressure-side pressure and the duration of the cooling operation of the air conditioner, the air conditioner is controlled to switch to perform the heating operation; during the heating operation of the air conditioner, the temperature at the bottom of the outdoor heat exchanger is acquired, and the duration of the heating operation of the air conditioner is recorded; and based on the temperature at the bottom of the outdoor heat exchanger and the duration of the heating operation of the air conditioner, the air conditioner is controlled to exit the self-cleaning mode. In this way, the problems of an insufficient frosting degree and an incomplete cleaning effect during the self-cleaning process of the air conditioner can be solved, thereby further improving the cleaning effect of the air conditioner and improving the user experience.

In addition, the self-cleaning control method for the air conditioner according to the embodiments of the present disclosure has following additional technical features.

According to an embodiment of the present disclosure, said controlling, based on the high-pressure-side pressure and the duration of the cooling operation of the air conditioner, the air conditioner to switch to perform the heating operation includes: determining whether the high-pressure-side pressure is greater than or equal to a first pressure threshold or whether the duration of the cooling operation of the air conditioner is longer than or equal to a first time threshold; and controlling, in response to the high-pressure-side pressure being greater than or equal to the first pressure threshold or the duration of the cooling operation of the air conditioner being longer than or equal to the first time threshold, the air conditioner to switch to perform the heating operation.

According to an embodiment of the present disclosure, the first pressure threshold is 5.5 Mpa, and the first time threshold is 10 min.

According to an embodiment of the present disclosure, said controlling, based on the temperature at the bottom of the outdoor heat exchanger and the duration of the heating operation of the air conditioner, the air conditioner to exit the self-cleaning mode includes: determining whether the temperature at the bottom of the outdoor heat exchanger is greater than or equal to a first temperature threshold or whether the duration of the heating operation of the air conditioner is longer than or equal to a second time threshold; and controlling, in response to the temperature at the bottom of the outdoor heat exchanger being greater than or equal to the first temperature threshold or the duration of the heating operation of the air conditioner being longer than or equal to the second time threshold, the air conditioner to exit the self-cleaning mode.

According to an embodiment of the present disclosure, the first temperature threshold is 18° C. and the second time threshold is 10 min.

According to an embodiment of the present disclosure, the method further includes: during controlling of the air conditioner to perform the cooling operation, controlling the compressor to operate at a first frequency, controlling a throttling device to be opened at a first opening degree, and controlling an indoor fan and an outdoor fan to stop operating.

According to an embodiment of the present disclosure, the method further includes: during controlling of the air conditioner to perform the heating operation, controlling the compressor to operate at a second frequency, controlling the throttling device to be opened at a second opening degree, controlling the indoor fan to stop operating, and controlling the outdoor fan to operate at a first rotation speed.

According to an embodiment of the present disclosure, the second opening degree is greater than the first opening degree.

In order to achieve the above objective, a self-cleaning control device of an air conditioner according to embodiments of a second aspect of the present disclosure includes: a pressure detection unit configured to detect a high-pressure-side pressure of an exhaust port of a compressor; a temperature detection unit configured to detect a temperature at a bottom of an outdoor heat exchanger; and a control unit connected to the pressure detection unit and the temperature detection unit respectively. The control unit is configured to: control, in response to the air conditioner entering a self-cleaning mode, the air conditioner to perform a cooling operation; during the cooling operation of the air conditioner, acquire a high-pressure-side pressure of an exhaust port of a compressor, and record a duration of the cooling operation of the air conditioner; control, based on the high-pressure-side pressure and the duration of the cooling operation of the air conditioner, the air conditioner to switch to perform a heating operation; during the heating operation of the air conditioner, acquire a temperature at a bottom of an outdoor heat exchanger, and record a duration of the heating operation of the air conditioner; and control, based on the temperature at the bottom of the outdoor heat exchanger and the duration of the heating operation of the air conditioner, the air conditioner to exit the self-cleaning mode.

According to the self-cleaning control device of the air conditioner, the high-pressure-side pressure of the exhaust port of the compressor is detected by the pressure detection unit; the temperature at the bottom of the outdoor heat exchanger is detected by the temperature detection unit; further, in response to the air conditioner entering the self-cleaning mode, the air conditioner is controlled to perform the cooling operation; during the cooling operation of the air conditioner, the high-pressure-side pressure of the exhaust port of the compressor is acquired, and the duration of the cooling operation of the air conditioner is recorded; based on the high-pressure-side pressure and the duration of the cooling operation of the air conditioner, the air conditioner is controlled to switch to perform the heating operation control; during the heating operation of the air conditioner, the temperature at the bottom of the outdoor heat exchanger is acquired, and the duration of the heating operation of the air conditioner is recorded; and based on the temperature at the bottom of the outdoor heat exchanger and the duration of the heating operation of the air conditioner, the air conditioner is controlled to exit the self-cleaning mode. In this way, the problems of an insufficient frosting degree and an incomplete cleaning effect during the self-cleaning process of the air conditioner can be solved, thereby further improving the cleaning effect of the air conditioner and improving the user experience.

In order to achieve the above objective, embodiments of a third aspect of the present disclosure provide an air conditioner including the self-cleaning control device of the air conditioner.

The air conditioner provided by the embodiments of the present disclosure adopts the self-cleaning control device of the air conditioner, so that the problems of an insufficient frosting degree and an incomplete cleaning effect during the self-cleaning process of the air conditioner can be solved, thereby further improving the cleaning effect of the air conditioner and improving the user experience.

In order to achieve the above objective, a computer readable storage medium according to embodiments of a fourth aspect of the present disclosure has a self-cleaning control program for an air conditioner stored thereon. The self-cleaning control program, when executed by a processor, implements the self-cleaning control method for the air conditioner as described above.

According to the computer readable storage medium provided by the embodiments of the present disclosure, the self-cleaning control program for the air conditioner is stored on the computer readable storage medium, which can solve the problems of an insufficient frosting degree and an incomplete cleaning effect during the self-cleaning process of the air conditioner, thereby further improving the cleaning effect of the air conditioner and improving the user experience.

Additional aspects and advantages of the present disclosure will be given in part in the following descriptions, become apparent in part from the following descriptions, or be learned from the practice of the embodiments of the present disclosure.

BRIEF DESCRIPTION OF DRAWINGS

The above and/or other aspects and advantages of the present disclosure will become apparent and more readily appreciated from the following descriptions made with reference to the accompanying drawings, in which.

DESCRIPTION OF EMBODIMENTS

Figure 1:
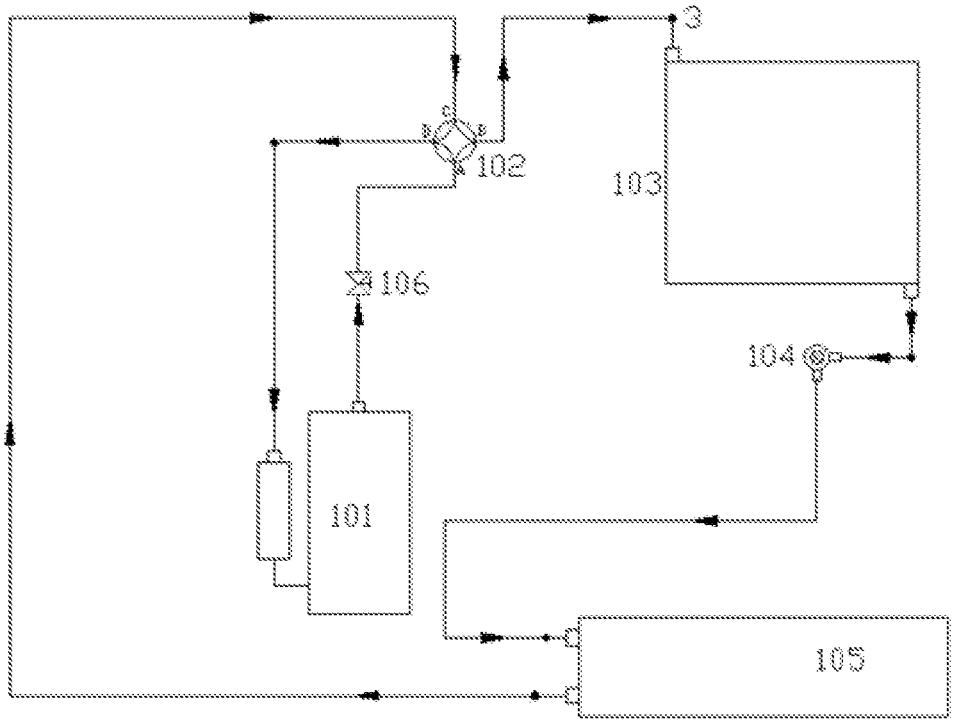
FIG. 1 is a schematic structural diagram of an air conditioner according to embodiments of the present disclosure.

Embodiments of the present disclosure are described below, and examples of the embodiments are illustrated in the accompanying drawings, throughout which same or similar reference numerals refer to the same or similar elements or elements having the same or similar functions. The embodiments described below with reference to the accompanying drawings are illustrative and intended to explain the present disclosure and should not be construed as limiting the present disclosure.

An air conditioner, a self-cleaning control method thereof, a self-cleaning control device therefor, and a storage medium according to embodiments of the present disclosure will be described below with reference to the accompanying drawings.

Before describing the air conditioner, the self-cleaning control method thereof, the self-cleaning control device therefor, and the storage medium according to embodiments of the present disclosure, structures of the air conditioner according to the embodiments of the present disclosure will be described.

As shown in FIG. 1, the air conditioner according to the embodiments of the present disclosure includes a compressor 101, a four-way reversing valve 102, an outdoor heat exchanger 103, an electronic expansion valve 104 (hereinafter, a throttling device), an indoor heat exchanger 105, and a high-pressure detection valve 106. The high-pressure detection valve 106 is disposed between the compressor 101 and the four-way reversing valve 102 to obtain the high-pressure-side pressure of an exhaust port of the compressor. The remaining structures of the air conditioner operate in a same or similar operation principle to those of an air conditioner in the related art, which will not be elaborated here.

Figure 2:
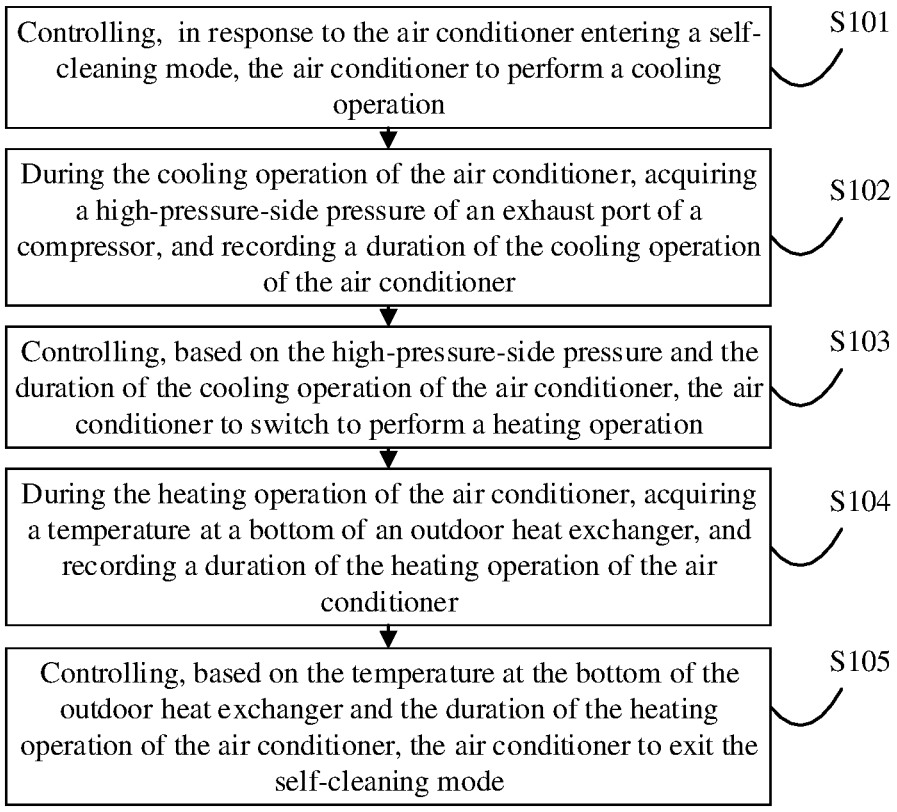
FIG. 2 is a flow chart illustrating a self-cleaning control method for an air conditioner according to embodiments of the present disclosure.

FIG. 2 is a flow chart illustrating a self-cleaning control method for the air conditioner according to embodiments of the present disclosure.

As shown in FIG. 2, the self-cleaning control method for the air conditioner includes the following steps.

At S101, the air conditioner is controlled, in response to the air conditioner entering a self-cleaning mode, to perform a cooling operation.

Optionally, a user can control the air conditioner to enter the self-cleaning mode through a remote controller of the air conditioner or an APP on a mobile terminal.

At S102, during the cooling operation of the air conditioner, a high-pressure-side pressure of an exhaust port of the compressor is acquired, and a duration of the cooling operation of the air conditioner is recorded.

That is, during the cooling operation of the air conditioner, the high-pressure-side pressure P of the exhaust port of the compressor can be obtained through the high-pressure detection valve disposed between the compressor and the four-way reversing valve, the duration SL of the cooling operation of the air conditioner is recorded, and whether to control the air conditioner to switch to a heating operation is determined based on the high-pressure-side pressure P and the duration SL of the cooling operation of the air conditioner.

At S103, the air conditioner is controlled, based on the high-pressure-side pressure and the duration of the cooling operation of the air conditioner, to switch to perform a heating operation.

Figure 3:
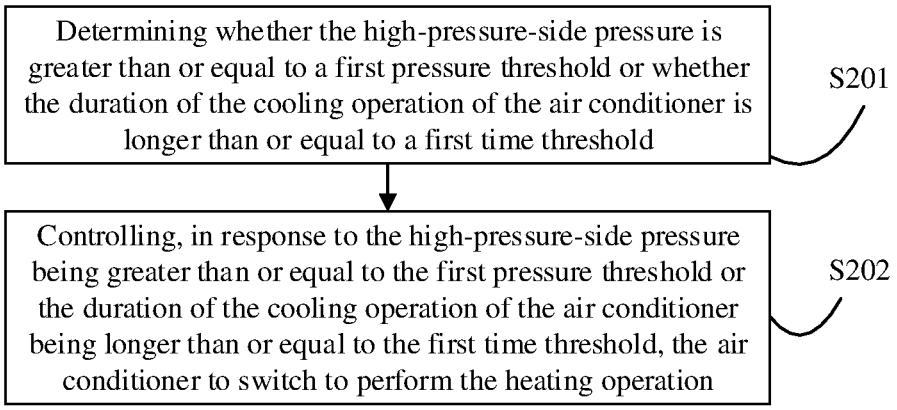
FIG. 3 is a flow chart illustrating a self-cleaning control method for an air conditioner according to an embodiment of the present disclosure.

For example, in embodiments of the present disclosure, as shown in FIG. 3, said controlling, based on the high-pressure-side pressure and the duration of the cooling operation of the air conditioner, the air conditioner to switch to perform the heating operation includes the following steps.

At S201, whether the high-pressure-side pressure is greater than or equal to a first pressure threshold or whether the duration of the cooling operation of the air conditioner is longer than or equal to a first time threshold is determined.

Optionally, a first pressure threshold P1 and a first time threshold S1 can be set accordingly based on parameters of the air conditioner. For example, in an embodiment of the present disclosure, the first pressure threshold P1 may be set to 5.5 Mpa, and the first time threshold S1 may be set to 10 min.

At S202, the air conditioner is controlled, in response to the high-pressure-side pressure being greater than or equal to the first pressure threshold or the duration of the cooling operation of the air conditioner being longer than or equal to the first time threshold, to switch to perform the heating operation.

That is, when the high-pressure-side pressure P is greater than or equal to the first pressure threshold P1 or the duration SL of the cooling operation of the air conditioner is longer than or equal to the first time threshold S1, for example, P is greater than or equal to 5.5 Mpa or SL is longer than or equal to 10 min, it is considered that a frosting degree during the cooling operation of the air conditioner reaches a self-cleaning requirement of the air conditioner, and at this time, the air conditioner is controlled to switch to perform the heating operation and enter a defrosting and self-cleaning process.

It should be understood that when the high-pressure-side pressure P and the duration SL of the cooling operation of the air conditioner do not satisfy a condition for controlling the air conditioner to switch to perform the heating operation, the air conditioner can be controlled to maintain the cooling operation so as to control the air conditioner to continue frosting.

At S104, during the heating operation of the air conditioner, a temperature at a bottom of an outdoor heat exchanger is acquired, and a duration of the heating operation of the air conditioner is recorded.

Optionally, during the heating operation of the air conditioner, a temperature T at the bottom of the outdoor heat exchanger can be acquired through a temperature sensor disposed at the bottom of the outdoor heat exchanger, the duration SR of the heating operation of the air conditioner is recorded, and then whether to control the air conditioner to exit the self-cleaning mode is determined based on the temperature T at the bottom of the outdoor heat exchanger and the duration SR of the heating operation of the air conditioner.

And S105, the air conditioner is controlled, based on the temperature at the bottom of the outdoor heat exchanger and the duration of the heating operation of the air conditioner, to exit the self-cleaning mode.

Figure 4:
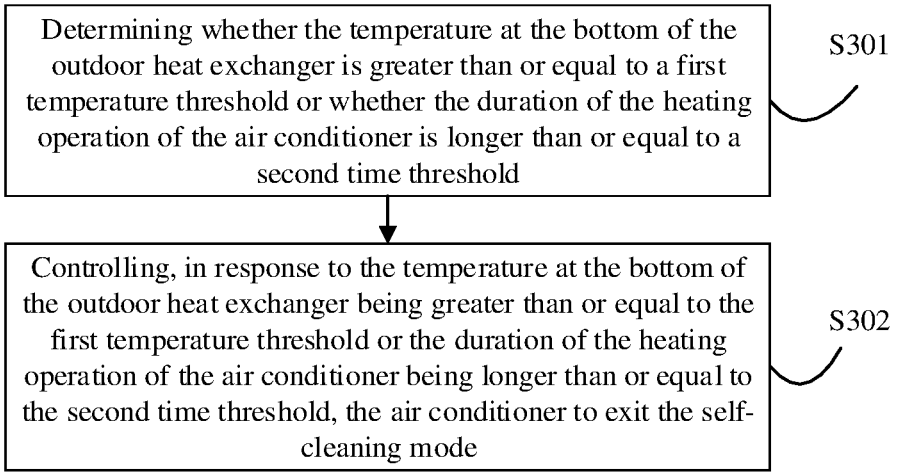
FIG. 4 is a flow chart illustrating a self-cleaning control method for an air conditioner according to another embodiment of the present disclosure.

For example, in the embodiments of the present disclosure, as shown in FIG. 4, said controlling, based on the temperature at the bottom of the outdoor heat exchanger and the duration of the heating operation of the air conditioner, the air conditioner to exit the self-cleaning mode includes the following steps.

At S301, whether the temperature at the bottom of the outdoor heat exchanger is greater than or equal to a first temperature threshold or whether the duration of the heating operation of the air conditioner is longer than or equal to a second time threshold is determined.

Optionally, a first temperature threshold T1 and a second time threshold S2 may be set accordingly based on operation parameters of the air conditioner. For example, in the embodiments of the present disclosure, the first temperature threshold T1 may be set to 18° C. and the second time threshold S2 may be set to 10 min.

At S302, the air conditioner is controlled, in response to the temperature at the bottom of the outdoor heat exchanger being greater than or equal to the first temperature threshold or the duration of the heating operation of the air conditioner being longer than or equal to the second time threshold, to exit the self-cleaning mode.

That is, when the temperature T at the bottom of the outdoor heat exchanger is greater than or equal to the first temperature threshold T1 or the duration SR of the heating operation of the air conditioner is longer than or equal to the second time threshold S2, for example, T is greater than or equal to T1, or SR is longer than or equal to S2, it is considered that the air conditioner has finished defrosting and self-cleaning, and at this time, the air conditioner is controlled to exit the self-cleaning mode.

It should be understood that when neither the temperature T at the bottom of the outdoor heat exchanger nor the duration SR of the heating operation of the air conditioner satisfies a condition for controlling the air conditioner to exit the self-cleaning mode, the air conditioner may be controlled to maintain the heating operation so as to control the air conditioner to continue defrosting and self-cleaning.

Further, in the embodiments of the present disclosure, during controlling of the air conditioner to perform the cooling operation, the compressor is controlled to operate at a first frequency, the throttling device is controlled to be opened at a first opening degree, and an indoor fan and an outdoor fan are controlled to stop operating.

It should be understood that, during controlling of the air conditioner to perform the cooling operation, by controlling the compressor to operate at the first frequency, controlling the throttling device to be opened at the first opening degree, and controlling the indoor fan and the outdoor fan to stop operating, the air conditioner is controlled to perform the frosting operation.

Optionally, the first frequency and the first opening degree can be set based on operation parameters of the air conditioner. For example, the first frequency may be set to 70 Hz, and the first opening degree may be set to one fifth of a maximum opening degree of the throttling device.

Further, in the embodiments of the present disclosure, during controlling of the air conditioner to perform the heating operation, the compressor is controlled to operate at a second frequency, the throttling device is controlled to be opened at a second opening degree, an indoor fan is controlled to stop operating, and an outdoor fan is controlled to operate at a first rotation speed.

It should be understood that, during controlling of the air conditioner to perform the heating operation, by controlling the compressor to operate at the second frequency, controlling the throttling device to be opened at the second opening degree, controlling the indoor fan to stop operating, and controlling the outdoor fan to operate at the first rotating speed, the air conditioner is controlled to perform defrosting and self-cleaning.

Optionally, the second frequency, the second opening degree, and the first rotation speed can be set based on operation parameters of the air conditioner. The second frequency may be set to 70 Hz, the second opening degree may be set to one third of a maximum opening degree of the throttling device, and the second rotation speed may be set to 850 rad/min.

It is to be understood that, in the embodiments of the present disclosure, the second opening degree is greater than the first opening degree.

Figure 5:
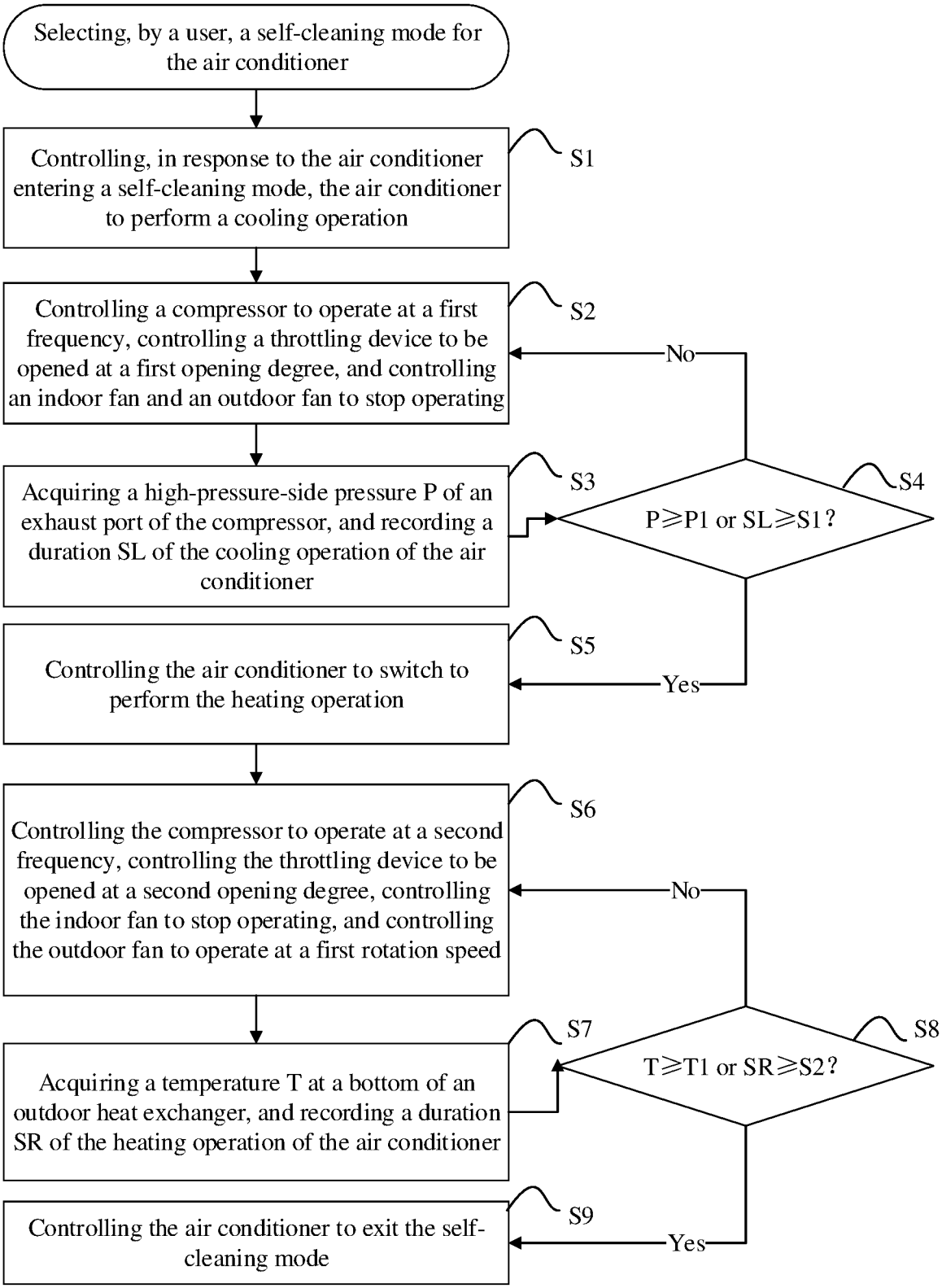
FIG. 5 is a flow chart illustrating a method for self-cleaning control of an air conditioner according to a specific embodiment of the present disclosure.

Referring to FIG. 5, a self-cleaning control method for the air conditioner according to embodiments of the present disclosure will be further described. After the user selects a self-cleaning mode of the air conditioner, step S1 is performed.

At S1, the air conditioner is controlled, in response to the air conditioner entering a self-cleaning mode, to perform a cooling operation.

At S2, the compressor is controlled to operate at a first frequency, the throttling device is controlled to be opened at a first opening degree, and an indoor fan and an outdoor fan are controlled to stop operating.

At S3, a high-pressure-side pressure P of an exhaust port of the compressor is acquired, and a duration SL of the cooling operation of the air conditioner is recorded.

Optionally, the high-pressure-side pressure P of the exhaust port of the compressor may be detected every 10 seconds.

At S4, whether the high-pressure-side pressure P is greater than or equal to a first pressure threshold P1 or whether the duration SL of the cooling operation of the air conditioner is longer than or equal to a first time threshold S1 is determined. If yes, step S5 is performed; and if no, step S2 is performed.

At S5, the air conditioner is controlled to switch to perform a heating operation.

At S6, the compressor is controlled to operate at a second frequency, the throttling device is controlled to be opened at a second opening degree, the indoor fan is controlled to stop operating, and the outdoor fan is controlled to operate at a first rotation speed.

At S7, a temperature T at a bottom of an outdoor heat exchanger is acquired, and a duration SR of the heating operation of the air conditioner is recorded.

At S8, whether the temperature T at the bottom of the outdoor heat exchanger is greater than or equal to a first temperature threshold T1 or whether the duration SR of the heating operation of the air conditioner is longer than or equal to a second time threshold S2 is determined. If yes, step S9 is performed; and if no, step S6 is performed.

At S9, the air conditioner is controlled to exit the self-cleaning mode.

In summary, according to the self-cleaning control method for the air conditioner, the air conditioner is controlled, in response to the air conditioner entering the self-cleaning mode, to perform a cooling operation; during the cooling operation of the air conditioner, the high-pressure-side pressure of the exhaust port of the compressor is acquired, and the duration of the cooling operation of the air conditioner is recorded; further, the air conditioner is controlled, based on the high-pressure-side pressure and the duration of the cooling operation of the air conditioner, to switch to perform the heating operation; in addition, during the heating operation of the air conditioner, the temperature at the bottom of the outdoor heat exchanger is acquired, and the duration of the heating operation of the air conditioner is recorded; and the air conditioner is controlled, based on the temperature at the bottom of the outdoor heat exchanger and the duration of the heating operation of the air conditioner, to exit the self-cleaning mode. In this way, the problems of an insufficient frosting degree and an incomplete cleaning effect during the self-cleaning process of the air conditioner can be solved, thereby further improving the cleaning effect of the air conditioner and improving the user experience.

Figure 6:
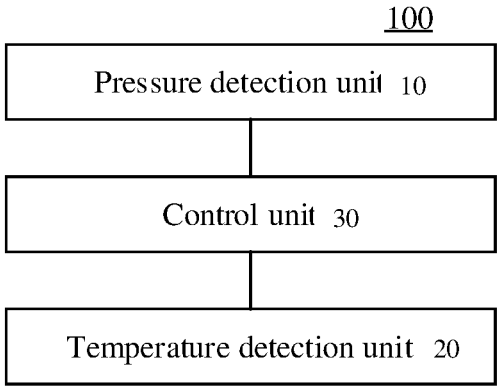
FIG. 6 is a block diagram illustrating a self-cleaning control device of an air conditioner according to embodiments of the present disclosure.

FIG. 6 is a block diagram illustrating a self-cleaning control device of the air conditioner according to embodiments of the present disclosure.

As shown in FIG. 6, the self-cleaning control device 100 of the air conditioner includes: a pressure detection unit 10, a temperature detection unit 20, and a control unit 30.

The pressure detection unit 10 is configured to detect a high-pressure-side pressure of an exhaust port of the compressor. The temperature detection unit 20 is configured to detect a temperature at a bottom of the outdoor heat exchanger. The control unit 30 is connected to the pressure detection unit 10 and the temperature detection unit 20, respectively. The control unit 30 is configured to: control, in response to the air conditioner entering a self-cleaning mode, the air conditioner to perform a cooling operation; during the cooling operation of the air conditioner, acquire a high-pressure-side pressure of an exhaust port of the compressor, and record a duration of the cooling operation of the air conditioner; control, based on the high-pressure-side pressure and the duration of the cooling operation of the air conditioner, the air conditioner to switch to perform a heating operation; during the heating operation of the air conditioner, acquire a temperature at a bottom of the outdoor heat exchanger, and record a duration of the heating operation of the air conditioner; and control, based on the temperature at the bottom of the outdoor heat exchanger and the duration of the heating operation of the air conditioner, the air conditioner to exit the self-cleaning mode.

For example, the control unit 30 according to the embodiments of the present disclosure controls, based on the duration of the cooling operation of the air conditioner and the high-pressure-side pressure detected by the pressure detection unit 10, the air conditioner to switch to perform the heating operation, and controls, based on the duration of the heating operation of the air conditioner and the temperature at the bottom of the outdoor heat exchanger detected by the temperature detection unit 20, the air conditioner to exit the self-cleaning mode. In this way, the problems of an insufficient frosting degree and an incomplete cleaning effect during the self-cleaning process of the air conditioner can be solved, thereby further improving the cleaning effect of the air conditioner and improving the user experience.

It should be noted that the self-cleaning control device 100 of the air conditioner according to the embodiments of the present disclosure corresponds to the above-mentioned implementations of the self-cleaning control method for the air conditioner according to the above embodiments of the present disclosure, which will not be elaborated here.

In summary, according to the self-cleaning control device of the air conditioner, the high-pressure-side pressure of the exhaust port of the compressor is detected by the pressure detection unit, and the temperature at the bottom of the outdoor heat exchanger is detected by the temperature detection unit; the air conditioner is controlled, in response to the air conditioner entering the self-cleaning mode, to perform the cooling operation; during the cooling operation of the air conditioner, the high-pressure-side pressure of the exhaust port of the compressor is acquired, and the duration of the cooling operation of the air conditioner is recorded; the air conditioner is controlled, based on the high-pressure-side pressure and the duration of the cooling operation of the air conditioner, to switch to perform the heating operation; during the heating operation of the air conditioner, the temperature at the bottom of the outdoor heat exchanger is acquired, and the duration of the heating operation of the air conditioner is recorded; and the air conditioner is controlled, based on the temperature at the bottom of the outdoor heat exchanger and the duration of the heating operation of the air conditioner, to exit the self-cleaning mode. In this way, the problems of an insufficient frosting degree and an incomplete cleaning effect during the self-cleaning process of the air conditioner can be solved, thereby further improving the cleaning effect of the air conditioner and improving the user experience.

Figure 7:
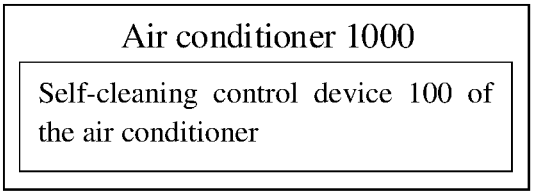
FIG. 7 is a block schematic diagram of an air conditioner according to embodiments of the present disclosure.

FIG. 7 is a block schematic diagram of an air conditioner according to certain embodiments of the present disclosure.

As shown in FIG. 7, an air conditioner 1000 includes the aforementioned self-cleaning control device 100 of the air conditioner, and can realize the respective implementation of the self-cleaning control device 100 of the air conditioner described above.

According to the air conditioner provided by the embodiments of the present disclosure, the self-cleaning control device of the air conditioner is adopted, so that the problems of an insufficient frosting degree and an incomplete cleaning effect during the self-cleaning process of the air conditioner can be solved, thereby further improving the cleaning effect of the air conditioner and improving the user experience.

Further, in the embodiments of the present disclosure, a computer readable storage medium is further provided. The computer readable storage medium has a self-cleaning control program for an air conditioner stored thereon. The self-cleaning control program, when executed by a processor, implements the respective implementation of the self-cleaning control method for the air conditioner described above.

According to the computer readable storage medium provided by the embodiments of the present disclosure, the self-cleaning control program for the air conditioner is stored on the computer readable storage medium, so that the problems of an insufficient frosting degree and an incomplete cleaning effect during the self-cleaning process of the air conditioner can be solved, thereby further improving the cleaning effect of the air conditioner and improving the user experience.

Throughout this specification, description with reference to the term "an embodiment", "some embodiments", "an example", "a specific example", or "some examples" means that a particular feature, structure, material, or characteristic described in connection with the embodiment or example is included in at least one embodiment or example of the present disclosure. The illustrative representations of the above term throughout this specification are not necessarily referring to the same embodiment or example of the present disclosure. Furthermore, the particular features, structures, materials, or characteristics described may be combined in any suitable manner in one or more embodiments or examples. In addition, different embodiments or examples and features of different embodiments or examples described in the specification may be combined by those skilled in the art without mutual contradiction.

In addition, terms such as "first" and "second" are used herein for purposes of description only and are not intended to indicate or imply relative importance or significance or a quantity of the indicated feature. Thus, the feature defined with "first" and "second" may explicitly or implicitly include one or more this feature. In the description of the present disclosure, "a plurality of" means at least two, for example, two or three, unless specified otherwise.

Any process or method described in a flow chart or described herein in other ways may be understood to include one or more modules, segments or portions that can implement codes of executable instructions of customized logical functions or steps in the process. The scope of preferred embodiments of the present disclosure includes other implementations, which implement functions in an order other than the order shown or discussed, including a substantially simultaneous manner or a reverse order depending on the involved functions, which should be understood by those skilled in the art.

The logic and/or steps described shown in the flow chart or described in other manners herein, for example, may be considered as a particular sequence of executable instructions for realizing the logical function, may be specifically implemented in any computer-readable medium to be used by the instruction execution system, device or equipment (e.g., the system based on computers, the system including processors or other systems capable of obtaining the instruction from the instruction execution system, device and equipment and executing the instruction), or to be used in combination with the instruction execution system, device and equipment. As to the specification, "the computer-readable medium" may be any device adaptive for including, storing, communicating, propagating or transferring programs to be used by or in combination with the instruction execution system, device or equipment. More specific examples of the computer-readable medium include but are not limited to: an electronic connection (an electronic device) with one or more wires, a portable computer enclosure (a magnetic device), a random-access memory (RAM), a read-only memory (ROM), an erasable programmable read-only memory (EPROM or a flash memory), an optical fiber device and a portable compact disk read-only memory (CDROM). In addition, the computer readable medium may even be a paper or other appropriate medium capable of printing programs thereon, this is because, for example, the paper or other appropriate medium may be optically scanned and then edited, decrypted or processed with other appropriate methods when necessary to obtain the programs in an electric manner, and then the programs may be stored in a computer memory.

It should be understood that each part of the present disclosure may be realized by hardware, software, firmware or a combination thereof. In the above embodiments, a plurality of steps or methods may be realized by software or firmware stored in the memory and executed by an appropriate instruction execution system. For example, if it is realized by the hardware, likewise in another embodiment, it may be realized by one or a combination of the following techniques known in the art: a discrete logic circuit having a logic gate circuit for performing a logic function on a data signal, an application-specific integrated circuit having an appropriate combination logic gate circuit, a programmable gate array (PGA), a field programmable gate array (FPGA), etc.

It would be understood by those skilled in the art that all or a part of the steps carried by the method in the above-described embodiments may be completed by relevant hardware instructed by a program. The program may be stored in a computer-readable storage medium. When the program is executed, one or a combination of the steps of the method in the above-described embodiments may be included.

In addition, individual functional units in the embodiments of the present disclosure may be integrated in one processing module or may be separately physically present, or two or more units may be integrated in one module. The integrated module as described above may be achieved in the form of hardware, or may be achieved in the form of a software functional module. If the integrated module is achieved in the form of a software functional module and sold or used as a separate product, the integrated module may also be stored in a computer-readable storage medium.

The storage medium mentioned above may be read-only memories, magnetic disks or CD, etc. Although embodiments of the present disclosure have been shown and described, it would be appreciated by those skilled in the art that the above embodiments are exemplary and cannot be construed as limiting the present disclosure, and changes, modifications alternatives, and variations can be made to the embodiments without departing from scope of the present disclosure.

What is claimed is:

1. A self-cleaning control method for an air conditioner, comprising:

controlling, in response to the air conditioner entering a self-cleaning mode, the air conditioner to perform a cooling operation;

during the cooling operation of the air conditioner, acquiring a high-pressure-side pressure of an exhaust port of a compressor, and recording a duration of the cooling operation of the air conditioner;

controlling, based on one of the high-pressure-side pressure and the duration of the cooling operation of the air conditioner, the air conditioner to switch to perform a heating operation;

during the heating operation of the air conditioner, acquiring a temperature of an outdoor heat exchanger, and recording a duration of the heating operation of the air conditioner; and controlling, based on one of the temperature of the outdoor heat exchanger and the duration of the heating operation of the air conditioner, the air conditioner to exit the self-cleaning mode.

2. The self-cleaning control method for the air conditioner according to claim 1, wherein said controlling, based on one of the high-pressure-side pressure and the duration of the cooling operation of the air conditioner, the air conditioner to switch to perform the heating operation comprises:

determining whether the high-pressure-side pressure is greater than or equal to a first pressure threshold; and controlling, in response to a determination that the high-pressure-side pressure is greater than or equal to the first pressure threshold, the air conditioner to switch to perform the heating operation.

3. The self-cleaning control method for the air conditioner according to claim 2, wherein the first pressure threshold is 5.5 Mpa.

4. The self-cleaning control method for the air conditioner according to claim 1, wherein said controlling, based on one of the high-pressure-side pressure and the duration of the cooling operation of the air conditioner, the air conditioner to switch to perform the heating operation comprises:

determining whether the duration of the cooling operation of the air conditioner is longer than or equal to a first time threshold; and controlling, in response to a determination that the duration of the cooling operation of the air conditioner is longer than or equal to the first time threshold, the air conditioner to switch to perform the heating operation.

5. The self-cleaning control method for the air conditioner according to claim 4, wherein the first time threshold is 10 min.

6. The self-cleaning control method for the air conditioner according to claim 1, wherein said controlling, based on one of the temperature of the outdoor heat exchanger and the duration of the heating operation of the air conditioner, the air conditioner to exit the self-cleaning mode comprises:

determining whether the temperature of the outdoor heat exchanger is greater than or equal to a first temperature threshold; and controlling, in response to a determination that the temperature of the outdoor heat exchanger is greater than or equal to the first temperature threshold, the air conditioner to exit the self-cleaning mode.

7. The self-cleaning control method for the air conditioner according to claim 6, wherein the first temperature threshold is 18° C.

8. The self-cleaning control method for the air conditioner according to claim 1, wherein said controlling, based on one of the temperature of the outdoor heat exchanger and the duration of the heating operation of the air conditioner, the air conditioner to exit the self-cleaning mode comprises:

determining whether the duration of the heating operation of the air conditioner is longer than or equal to a second time threshold; and controlling, in response to a determination that the duration of the heating operation of the air conditioner is longer than or equal to the second time threshold, the air conditioner to exit the self-cleaning mode.

9. The self-cleaning control method for the air conditioner according to claim 8, wherein the second time threshold is 10 min.

10. The self-cleaning control method for the air conditioner according to claim 1, further comprising:

during the controlling of the air conditioner to perform the cooling operation, controlling the compressor to operate at a first frequency, controlling a throttling device to be opened at a first opening degree, and controlling an indoor fan and an outdoor fan to stop operating.

11. The self-cleaning control method for the air conditioner according to claim 10, further comprising:

during the controlling of the air conditioner to perform the heating operation, controlling the compressor to operate at a second frequency, controlling the throttling device to be opened at a second opening degree, controlling the indoor fan to stop operating, and controlling the outdoor fan to operate at a first rotation speed.

12. The self-cleaning control method for the air conditioner according to claim 11, wherein the second opening degree is greater than the first opening degree.

13. A self-cleaning control device of an air conditioner, comprising:

a pressure sensor configured to detect a high-pressure-side pressure of an exhaust port of a compressor;

a temperature sensor configured to detect a temperature of an outdoor heat exchanger;

a processor connected to the pressure sensor and the temperature sensor respectively, wherein the processor is configured to:

control, in response to the air conditioner entering a self-cleaning mode, the air conditioner to perform a cooling operation;

during the cooling operation of the air conditioner, acquire a high-pressure-side pressure of an exhaust port of a compressor, and record a duration of the cooling operation of the air conditioner;

control, based on one of the high-pressure-side pressure and the duration of the cooling operation of the air conditioner, the air conditioner to switch to perform a heating operation;

during the heating operation of the air conditioner, acquire a temperature of an outdoor heat exchanger, and record a duration of the heating operation of the air conditioner; and control, based on one of the temperature of the outdoor heat exchanger and the duration of the heating operation of the air conditioner, the air conditioner to exit the self-cleaning mode.

14. An air conditioner, comprising the self-cleaning control device of the air conditioner according to claim 13.

15. A computer readable storage medium, having a self-cleaning control program for an air conditioner stored thereon, wherein the self-cleaning control program, when executed by a processor, implements the self-cleaning control method for the air conditioner according to claim 1.

* * * * *